United States Patent [19]

Reiche

[11] Patent Number: 4,531,262

[45] Date of Patent: Jul. 30, 1985

[54] SYSTEM FOR BLENDING TEXTILE FIBERS

[75] Inventor: Werner Reiche, Monchen-Gladbach, Fed. Rep. of Germany

[73] Assignee: Trützschler GmbH & Co. KG, Monchen-Gladbach, Fed. Rep. of Germany

[21] Appl. No.: 443,526

[22] Filed: Nov. 22, 1982

[30] Foreign Application Priority Data

Dec. 23, 1981 [DE] Fed. Rep. of Germany ..... 3151063

[51] Int. Cl.[3] ..... D01G 13/00

[52] U.S. Cl. ..... 19/145.5; 19/80 R; 19/105

[58] Field of Search ..... 19/145.5, 145.7, 200, 19/204, 205, 80 R, 97.5, 105

[56] References Cited

U.S. PATENT DOCUMENTS

| | | | |
|---|---|---|---|
| 3,648,330 | 3/1972 | Binder et al. | 19/145.5 |
| 3,750,235 | 8/1973 | Wise | 19/145.5 X |
| 4,103,398 | 8/1978 | Rhyne et al. | 19/145.5 |
| 4,399,590 | 8/1983 | Wildbolz | 19/145.5 |

FOREIGN PATENT DOCUMENTS

| | | | |
|---|---|---|---|
| 0044408 | 1/1982 | European Pat. Off. . | |
| 196821 | 6/1907 | Fed. Rep. of Germany . | |
| 1013552 | 1/1958 | Fed. Rep. of Germany . | |
| 511951 | 10/1971 | Switzerland . | |
| 735172 | 8/1955 | United Kingdom | 19/145.5 |
| 1036836 | 4/1964 | United Kingdom | 19/145.5 |
| 328595 | 2/1972 | U.S.S.R. | 19/145.5 |
| 806790 | 2/1981 | U.S.S.R. | 19/145.5 |

OTHER PUBLICATIONS

W. Mohr, "Die Kunst des Spinnens liegt im Mischen", chemiefasern 201, Nov. 1970, pp. 956–962.

*Primary Examiner*—Louis K. Rimrodt
*Attorney, Agent, or Firm*—Spencer & Frank

[57] ABSTRACT

Textile fibers are blended by introducing them in a pre-blender; performing an at least two-fold doubling of the textile fibers in the pre-blender; pneumatically introducing the textile fibers in a principal blender from the pre-blender; performing a multiple doubling of the textile fibers in the principal blender; and removing the textile fibers from said principal blender.

9 Claims, 4 Drawing Figures

SYSTEM FOR BLENDING TEXTILE FIBERS

BACKGROUND OF THE INVENTION

This invention relates to a system for blending (mixing) textile fibers wherein a plurality of serially arranged hoppers, such as feed chutes, feed chambers or the like are charged with fibers in sequence by means of a common pneumatic conveying apparatus arranged overhead. The fibers are removed from the hoppers through the bottom end thereof and are introduced into a common conveying apparatus.

From a given fiber bale lot in a rational manner a fiber blend should be formed to continuously ensure an optimal distribution of the fiber material as regards staple length, fineness, degree of maturity, color, etc. A proper blend is not only fundamental for the manufacture of yarns of unchanging high quality as regards their uniformity, breaking strength and coloring but also improves the running properties of the material during the successive processing. A known apparatus for making such a homogeneous blend is, for example, the Multi-Mixer MPM model manufactured by Trützschler GmbH & Co. KG, Mönchengladbach, Federal Republic of Germany. This known apparatus may have six, eight, ten or twelve hoppers. The multiplier number (tuft blend multiplication or doubling) corresponds to the number of hoppers. By means of the blend doubling there is obtained a particular homogenization of the fiber tufts, that is, the blend doubling has the purpose of compensating for fluctuations in the fiber material.

The essential characteristics of blender efficiency are the hourly output quantities and the quality of blend. According to the blending process performed by the Multi-Mixer MPM, in case of six hoppers a production rate of 600 kg/hour and in case of twelve hoppers a production rate of 1200 kg/hour is achieved. The quality of the blend is decisively determined by how uniformly the defects in the introduced material are distributed in the fiber material mass. It is decisive of the quality of the blend and it is therefore the principal purpose of the blender to evenly distribute the defects in a large fiber quantity, that is, to achieve an equalization of medium and long wave defects in the composition of the introduced fiber material. The greater the fiber material mass in which the fiber defects are to be uniformly distributed the more successful an equalization and thus the better the quality of the blend. Short-wave defects, that is, defects related to small fiber material quantities are in part compensated for during the opening of the bales. Up-to-date bale openers such as the Blendomat BDT model manufactured by Trützschler GmbH & Co. KG, Mönchengladbach, Federal Republic of Germany, limit the error from the start by removing the smallest possible quantities in series from a plurality of bales forming a bale lot.

SUMMARY OF THE INVENTION

It is an object of the invention to provide an improved system for blending textile fibers, particularly for equalizing, at a high output rate, short wave defects in the fiber material.

This object and others to become apparent as the specification progresses, are accomplished by the invention, according to which, briefly stated, the fibers are pre-mixed by performing at least a two-fold doubling and are subsequently introduced into the hoppers of a main blender.

In the known blending methods the number of doubling corresponds to the number of hoppers. In the Multi-Mixer MPM which operates with twelve hoppers, a twelve-fold tuft doubling is effected. If the Multi-Mixer is additively extended by three hoppers, a fifteen-fold doubling may be effected. In contradistinction, according to the invention, a fiber tuft doubling may be multiplied by first at least twice doubling the fiber material and then introducing the doubled material into the hoppers of the blender. In a Multi-Mixer with twelve hoppers, for example, a thirty-six-fold doubling is effected by means of the upstream arrangement of three hoppers according to the invention. Thus, with the invention, particularly by the serial arrangements of the pre-mixer and the main blender, an over-additive effect is achieved in an advantageous manner.

Expediently, the fiber material which has been at least twice doubled is intermingled once more, prior to its introduction into the hoppers of the main blender. By such intermingling there is meant the blending of the contents of the various components of the doubled (pre-mixed) fiber material to obtain a mixture which is uniform in itself.

The system according to the invention has at least one pre-blender which has at least two hoppers and which is coupled by means of a pneumatic conveyor with the principal blender (for example, a Multi-Mixer MPM) situated downstream of the pre-blender. Thus, the pneumatic conveyor is coupled at least with one pre-blender, from the hoppers of which the fibers are supplied to the common pneumatic conveyor. The inlet openings of the hoppers forming part of the pre-blender are preferably alternately charged. Preferably, the hoppers are charged in a continuous operation so that an uninterrupted functioning can be achieved. Expediently, the hoppers are feed chutes which are charged from above and from which the fiber is removed at the bottom. Preferably, the hoppers have, in the zone of their side walls, photocells for controlling the filling height. Preferably, between the pre-mixer or, as the case may be, the pre-mixers and the principal blender there is provided an intermediate blending (intermingler) device for additionally homogenizing the fiber material. The intermingler may be, for example, a conventional Axi-flo model, manufactured by Trützschler GmbH & Co. KG, Mönchengladbach, Federal Republic of Germany which at the same time functions as a cleaner for the fiber material. Expediently, the intermingler is built into the pneumatic conveying apparatus.

According to a further feature of the invention, the inlet openings of the pre-blender are sequentially alternately charged with a predetermined fiber quantity from an upstream arranged fiber processing machine such as a bale opener, a scale box feeder or a multi-component scale.

DESCRIPTION OF THE PREFERRED EMBODIMENTS

Figure 1:
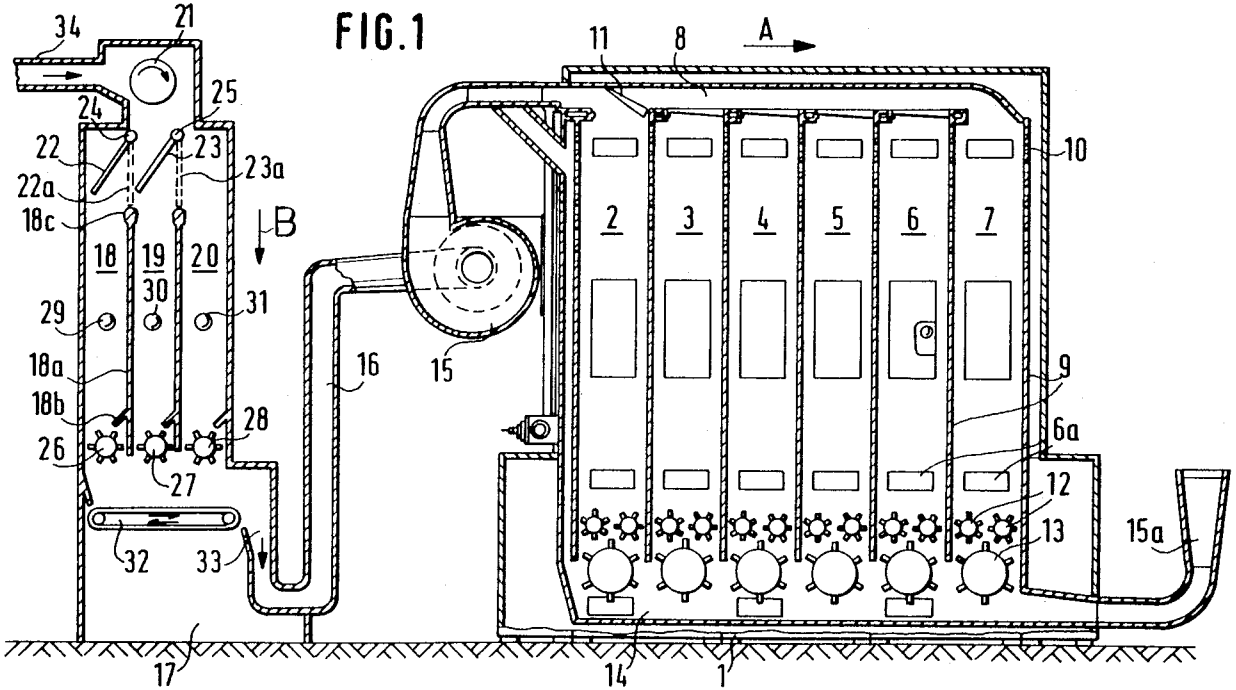
FIG. 1 is a schematic side elevational view of a preferred embodiment of the invention.

Turning to FIG. 1, there is shown a principal blender 1 which may be a conventional Multi-Mixer MPM model. The principal blender 1 has six serially arranged hoppers 2, 3, 4, 5, 6 and 7 communicating with an overhead duct 8 through which fibers are conveyed by an airstream in a direction indicated by the arrow A. The hopper walls 9 have air outlet openings 10 in the zone of their upper portions. Each of the hoppers 2 through 7 may be closed at the top by means of respective pivotal closures 11 which, in their open position as shown for the closure 11 of the hopper 2, close the downstream side of the duct 8. In the zone of the lower end of each of the hoppers 2 through 7 a delivery roller pair 12 and an opening roller 13 are arranged. Underneath the hoppers 2 through 7 a common blending channel 14 is arranged from which the fiber tufts deposited therein are conveyed towards a suction funnel 15 which is coupled to a condenser (not shown).

The fiber material is, by means of a fiber driving impeller 15, drawn through a pipe conduit 16 from an upstream arranged pre-blender 17 and delivered to the hoppers 2 through 7 of the main blender 1.

Figure 4:
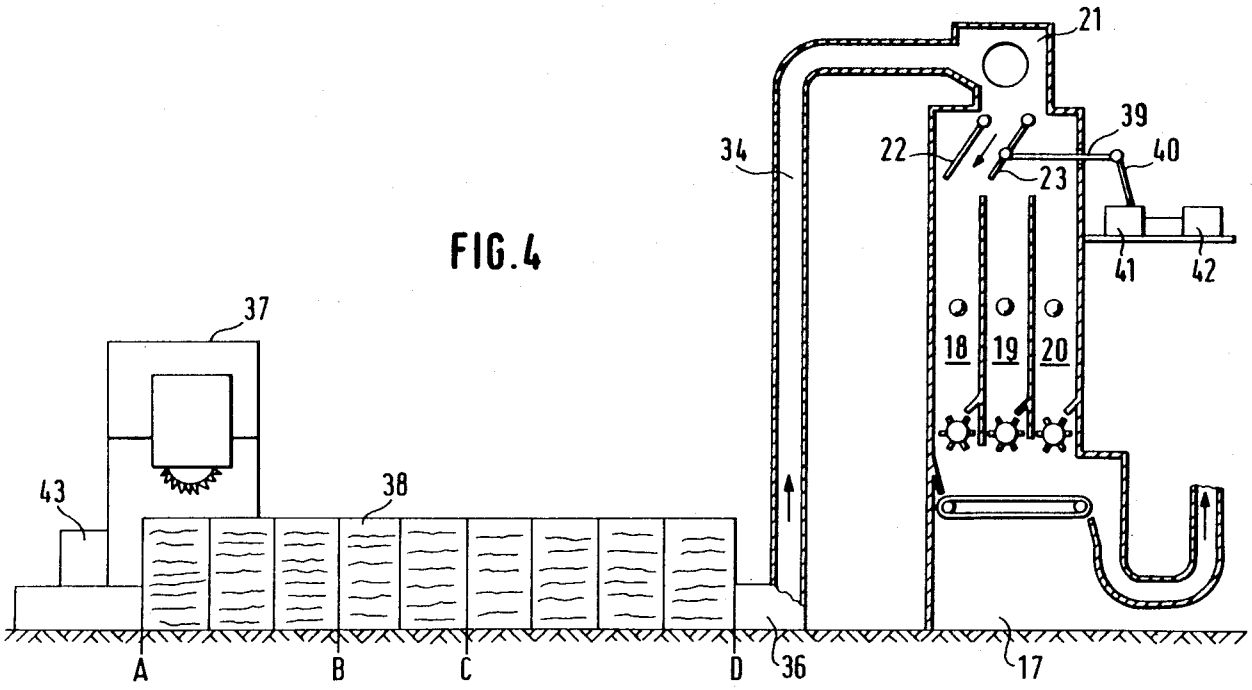
FIG. 4 is a schematic side elevational view of one part of still another preferred embodiment of the invention.

The pre-blender 17 has three serially arranged hoppers 18, 19 and 20 which receive fiber material from an overhead arranged sieve drum 21. Between the sieve drum 21 and the inlet openings of the chutes 18, 19, 20 there is arranged a dual pivotal gate 22, 23 which is supported by pivots 24 and 25 having a horizontal axis. The fiber material is, from the sieve drum 21, introduced between the pivotal gates 22, 23 in their solid-line position into the hopper 18 and in the broken-line position **22*a* and 23*a* into the hopper 19. The hopper 20 is charged after the pivotal gate is pivoted counterclockwise from the position 22*a*, 23*a* into a third position. At the lower end of each hopper 18, 19 and 20 there is provided a respective delivery roller 26, 27 and 28 which may be a star or finger roller. Above each delivery roller 26, 27 and 28 there is positioned, for example, a deflecting element (such as 18*b*) affixed to a wall (such as 18*a*) of each hopper 18, 19 and 20. The upper end of the inside walls (such as wall 18*a*) is provided with a rounded part (such as 18*c*). Each hopper 18, 19 and 20 has, mounted on the respective hopper wall, a respective photocell 29, 30 and 31 which protects the hopper from overfilling and idle runs. The position of the pivotal gate 22, 23 with respect to the hoppers 18, 19 and 20 may be controlled by means of the associated photocell 29, 30 or 31. For this purpose, the photocells 29, 30 and 31 are operatively connected with a drive motor (not shown) for advancing the fiber material, such as a motor associated with a material supply apparatus arranged upstream of the pre-blender 17. Such a motor, as shown in FIG. 4, may be, for example, a drive motor 43 of a bale opener 37. Underneath the hoppers 18, 19 and 20 there is arranged a common conveyor belt 32 which advances the deposited fiber tufts in the direction of a suction funnel 33 which communicates with the suction side of the fan 15 by means of a conduit 16. The fiber material is drawn from an upstream arranged machine, such as a bale opener, through a conduit 34 and fed to the sieve drum 21**.

The fibers are, in the direction designated by the arrow B introduced into the hoppers 18, 19 and 20 approximately up to the height of the respective photocells 29, 30 and 31. As soon as the height of the tuft level sinks below the level of the photocells 29, 30 and 31, resupply of the tufts is resumed. Fiber tufts are removed from all three hoppers 18, 19 and 20 simultaneously and continuously by the rollers 26, 27 and 28 and deposited on the conveyor 32. The thrice doubled fiber material leaving the pre-mixer 17 is, by means of the pneumatic conveyor formed of the duct 16, the fan 15 and the duct 8, sequentially introduced into the hoppers 2 through 7 of the main blender 1. The pre-blender 17 and the main blender 1 thus together achieve an eighteen-fold doubling (three pre-mixer hoppers times six main blender hoppers) of the fiber material.

Figure 2:
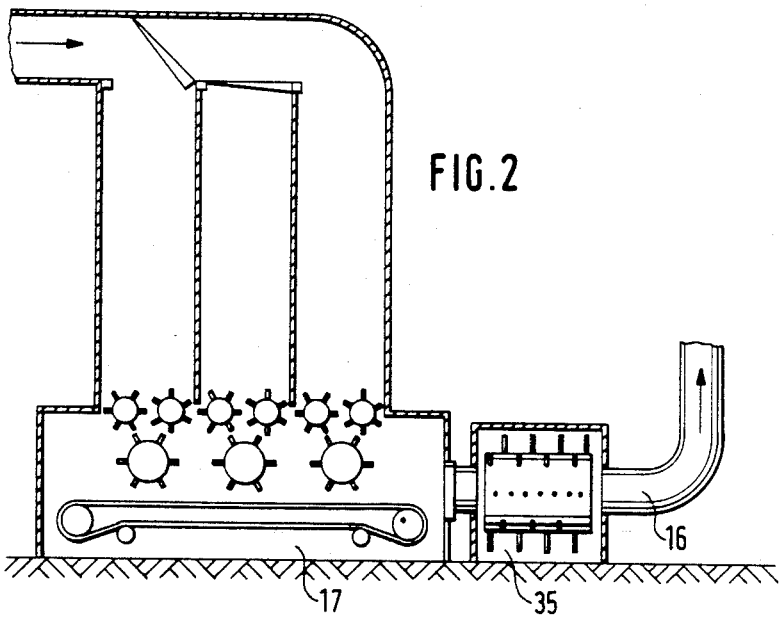
FIG. 2 is a schematic side elevational view of one part of another preferred embodiment of the invention.

Turning now to FIG. 2, downstream of the pre-blender 17 there is arranged a continuous mixer 35 (intermingler) which may be an Axi-flo model cleaner manufactured by Trützschler GmbH & Co. KG, Mönchengladbach, Federal Republic of Germany. The inlet of the mixer 35 is coupled to the outlet of the pre-mixer 17 whereas the outlet of the continuous mixer 35 is coupled to the duct 16. The thrice doubled fiber material discharged by the pre-blender 17 is thoroughly mixed in the intermingler 35.

Figure 3:
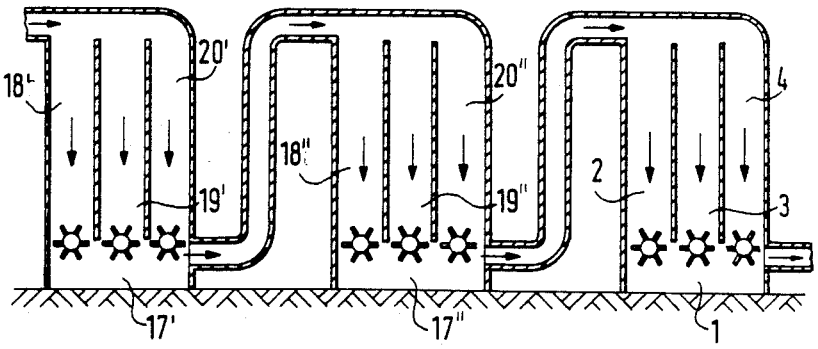
FIG. 3 is a schematic side elevational view of still another preferred embodiment of the invention.

Turning now to FIG. 3, there are shown two pre-blenders 17' and 17'' having three hoppers 18', 19' and 20' and, respectively, 18'', 19'' and 20''. The two pre-blenders 17' and 17'' are arranged upstream of the main blender 1 having three chutes 2, 3 and 4 (the arrows in FIG. 3 indicate the direction of fiber material flow). The two pre-blenders 17' and 17'' as well as the main blender 1 together achieve a twenty-seven-fold doubling of the fiber material (three times three times three).

Turning now to FIG. 4, the inlet openings of the hoppers 18, 19 and 20 of the pre-blender 17 may be charged sequentially in an alternating manner as described above. The sieve drum 21 of the pre-blender 17 is coupled by means of a pipe conduit 34 with a fiber tuft suction channel 36 of an upstream-arranged automatic bale opener 37, such as a Blendomat BDT. The bale lot is constituted by a plurality of serially arranged fiber bales 38 formed of three components A to B, B to C and C to D. Each component has a plurality of bales 38. The pivotal gates 22, 23 are coupled by setting devices 39, 40 to a setting apparatus 41 which is controlled, for example, by means of a time relay 42 and which, after a lapse of a predetermined period, pivots the gate from the hopper 18 to the hopper 19 or 20. The time relay 42 is so set that it switches when the component boundary between the components A through D is bridged by the opener. The setting apparatus 41 may be, in the alternative, controlled by measuring elements such as electric contacts which are arranged at the component boundaries A, B, C and D.

It will be understood that the above description of the present invention is susceptible to various changes, modifications and adaptations, and the same are intended to be comprehended within the meaning and range of equivalents of the appended claims.

What is claimed is:

1. In a system of a plurality of serially-connected fiber processing machines, including a blender having an inlet, a plurality of generally vertically oriented first hoppers, means for charging said first hoppers in succession from above, and discharge means for removing textile fibers mixed in said blender; the improvement wherein said system comprises (a) a pre-blender having (1) at least two generally vertically oriented second hoppers for pre-mixing textile fibers with an at least two-fold doubling and (2) an outlet for discharging textile fibers pre-mixed in the pre-blender;

(b) a conveyor duct connecting the outlet of said pre-blender with the inlet of said blender; and (c) pneumatic means for conveying textile fiber by a gas stream in said conveyor duct from the outlet of said pre-blender in the inlet of said blender, whereby short-wave defects in fiber material batches are equalized.

2. A system as defined in claim 1, wherein said first hoppers are feed chutes.

3. A system as defined in claim 1, wherein each said first hopper has an outlet opening at the bottom thereof for discharging textile fibers therethrough.

4. A system as defined in claim 1, further comprising height control means for regulating the height level of the textile fibers in said first hoppers; said first hoppers having vertical side walls; said height control means comprising photocells arranged in the zone of said side walls.

5. A system as defined in claim 1, further comprising a textile fiber intermingler operatively connected between said pre-blender and said blender for intermixing textile fibers pre-mixed in said pre-blender.

6. A system as defined in claim 5, wherein said intermingler is arranged in said conveyor duct.

7. A system as defined in claim 5, wherein said intermingler includes a textile fiber cleaner.

8. A system as defined in claim 1, further comprising means for charging said second hoppers in an alternating sequence from above.

9. A system as defined in claim 1, wherein one of said textile fiber processing machines is a fiber bale opener connected to said pre-blender for delivering textile fiber thereto.

* * * * *